OR 4,209,663

455/3

United States Patent [19]

Sekiguchi

[11] 4,209,663

[45] Jun. 24, 1980

[54] DRIVE-IN THEATER AUDIO SYSTEM

[76] Inventor: Kiichi Sekiguchi, 145 N. Almont Dr., #202, Los Angeles, Calif. 90048

[21] Appl. No.: 893,884

[22] Filed: Apr. 6, 1978

[51] Int. Cl.[2] ..... H04H 1/00

[52] U.S. Cl. ..... 179/1 DD; 179/1 B; 333/124; 455/57

[58] Field of Search ..... 179/1 DD, 1 B; 333/24 C, 6, 8; 325/54, 308

[56] References Cited

U.S. PATENT DOCUMENTS

| | | | |
|---|---|---|---|
| 1,900,106 | 3/1933 | Hamilton et al. | 179/1 B |
| 2,914,737 | 11/1959 | Tongue | 333/8 |
| 2,979,607 | 4/1961 | Herzfeld | 179/1 DD |
| 3,428,920 | 2/1969 | Oleksiak | 333/8 |
| 3,736,374 | 5/1973 | Gargini | 179/1 B |

*Primary Examiner*—Malcolm A. Morrison
*Assistant Examiner*—E. S. Kemeny
*Attorney, Agent, or Firm*—Krass & Young

[57] ABSTRACT

A system for utilizing audio frequency wiring circuits at drive-in theaters to transmit radio frequency signals to patron automobile radio receivers with increased efficiency and a reduction in radiation of the radio frequency signals. The system employs impedance matching networks, coupling networks and termination networks to enable the audio frequency wiring circuits to operate as transmission lines.

20 Claims, 3 Drawing Figures

DRIVE-IN THEATER AUDIO SYSTEM

BACKGROUND OF THE INVENTION

1. Field of the Invention

This invention relates to a system for utilizing audio wiring at drive-in theaters to transmit radio frequency signals to patrons' car radios with minimal electromagnetic wave leakage, and more particularly, to a system utilizing impedance matching networks and termination networks to enable the audio frequency wiring circuits to operate as transmission lines.

2. Description of Prior Art

In communicating the sound track portion of a motion picture to its patrons, drive-in theaters have utilized different types of systems. In one system audio from a movie projector is amplified by a high power audio frequency amplifier and then transmitted by means of underground wiring to many separate speakers distributed within the viewing area of the drive-in. This system requires that the number of speakers at least equal the number of automobiles within a drive-in theater, in order to deliver the sound track of the motion picture to patrons within each automobile. This type of audio distribution system has many shortcomings. First, each speaker must be of an outdoor all-weather type with the result that the audio quality usually is poor. Furthermore, it is relatively expensive to install and maintain the speakers even though they are constructed for outdoor use. Also, the speakers are subject to customer abuse, and maintenance and replacement costs are relatively high.

A second type of audio distribution system for a drive-in theater operates at radio frequencies and utilizes the audio from the sound track of the motion picture to modulate a radio frequency carrier having a frequency within the standard AM broadcasting band (540–1600 kilohertz). The radio frequency signal is then transmitted by wires to each patrons' automobile where it is coupled to the radio antenna. The radio frequency signal is then demodulated by the automobile radio and the motion picture audio sound is generated by the radio speaker. Since the audio quality of this radio frequency system is generally superior to that of the audio frequency system, it is desirable for drive-in theaters using an audio frequency system to convert to the radio frequency system. However, the conversion to a radio frequency system is relatively expensive because of the need to replace audio wiring with coaxial cables.

A partial solution to the expense of converting from an audio wiring system to a radio frequency signal system is disclosed in Herzfeld, U.S. Pat. No. 2,979,607. Herzfeld discloses a radio frequency system wherein the wiring formerly used for carrying the audio frequency signal is used to carry radio frequency signals from a centrally located radio frequency transmitter to each automobile radio antenna. One disadvantage of this arrangement, however, is that unless the output impedance of the radio frequency transmitter matches the impedance of the input end of the audio wiring, most of the radio frequency power will not reach the automobile radio antennas but rather will be reflected back into the transmitter. Another disadvantage of this arrangement is that unless the many output ends of the audio wiring are properly terminated, the audio wiring will act as a radiator instead of a transmission line. Since it is necessary to prevent interference with authorized transmissions having the same frequency as the drive-in system, it is accordingly desirable to utilize a system which limits radiation from the audio wiring.

SUMMARY OF THE INVENTION

The present invention broadly overcomes those problems by providing a system which utilizes impedance matching networks, coupling networks and termination networks with audio wiring to distribute a radio frequency signal to automobile radio antennas. By using impedance matching networks, coupling networks and termination networks the radio frequency power is efficiently carried to its destination instead of being reflected back into the radio frequency transmitter. A further feature of the invention is the reduction of electromagnetic radiation from the audio wiring system.

Other objectives, advantages and applications of the present invention will be made apparent by the following detailed description of the preferred embodiment of the invention. The description makes reference to the accompanying drawings in which.

Figure 1:
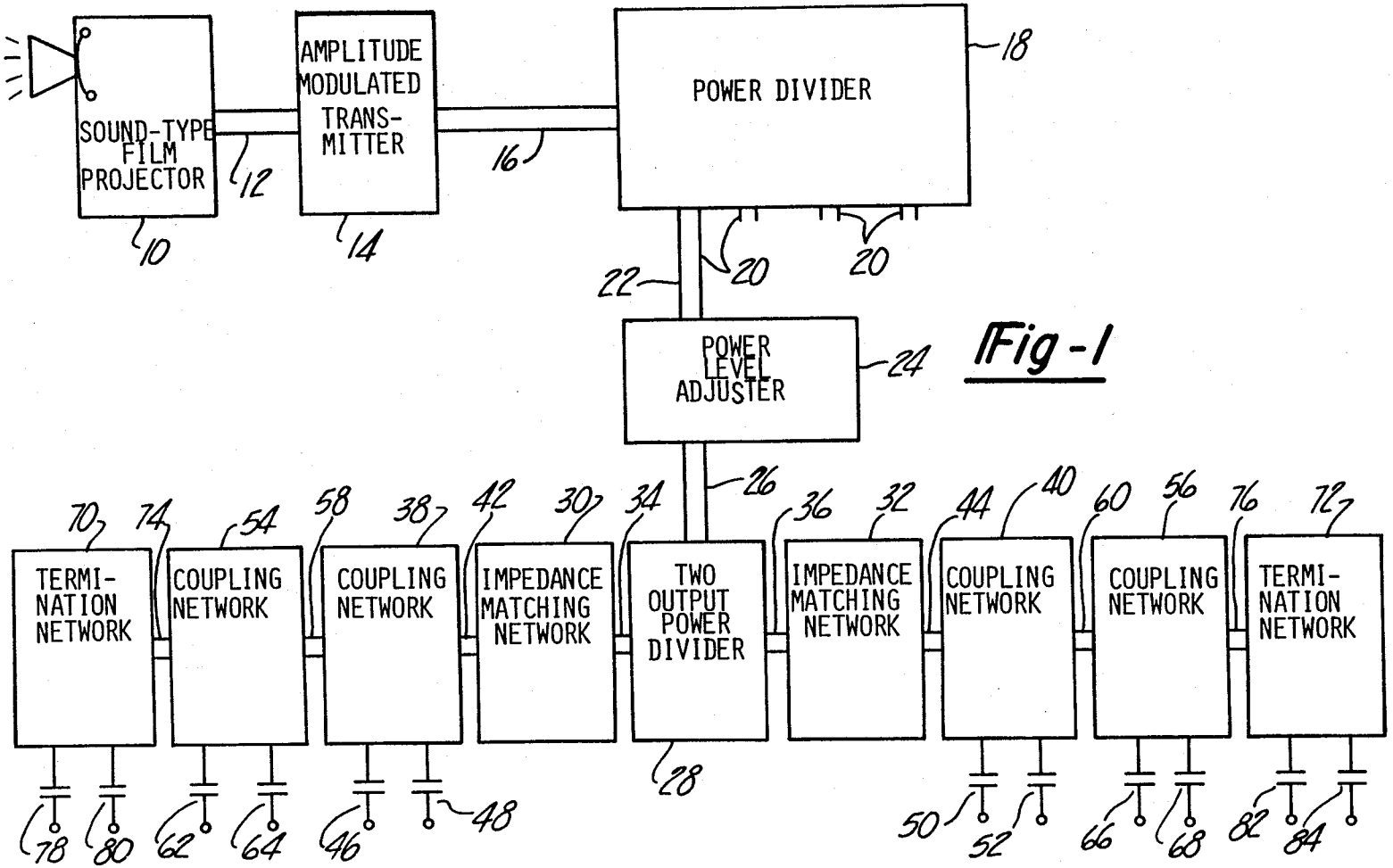
FIG. 1 is a block diagram of a system constituting a preferred embodiment of the invention; and, FIG. 2 is a schematic diagram of a coupling network employed in connection with the preferred embodiment of FIG. 1.

Referring to FIG. 1 the audio output of sound type film projector 10 provides an audio frequency signal to the audio frequency input of a transmitter 14 through audio frequency wiring 12. The carrier frequency of the transmitter 14 is typically within the standard broadcast band, substantially 540 to 1600 kilohertz, and the carrier is amplitude modulated by the audio frequency signal.

The radio frequency output of transmitter 14 is conducted by coaxial cable 16 to a first power divider 18, such that the radio frequency output is equally divided, and characteristic of each output is the same as the input of the divider. Power divider 18 is a passive network that divides radio frequency power between a plurality of outputs 20. Power dividers are well known in the art and can be embodied in many different forms.

The outputs of power divider 18 are connected to a plurality of circuits. One such circuit is shown in FIG. 1 where one output of divider 18 is connected to a power level adjuster 24 by coaxial cable 22. The power level adjuster 24 controls the level of power to its respective circuit in order to provide the proper radio frequency signal voltage to each automobile radio antenna. Power adjuster 22 is necessary since the transmission characteristics of each circuit may not be uniform. Power level adjuster 24 is a passive network that attenuates power while maintaining an input impedance equal to its output impedance. Such adjusters can be embodied in many different forms and are well-known in the art.

A second power divider 28 further divides the radio frequency power received from level adjuster 24 through coaxial cable 26 and provides two outputs having the same impedance as its input. The two outputs of power divider 28 are coupled to impedance matching networks 30 and 32 by coaxial cables 34 and 36 respectively.

Impedance matching networks 30 and 32 assure a full transfer of radio frequency power from coaxial cables 34 and 36 to the relatively higher impedance drive-in theater audio wiring circuits 42 and 44 respectively. Without the impedance matching devices, radio frequency power would be reflected back into coaxial cables 34 and 36 and ultimately back to transmitter 14, such that the radio frequency power would not effectively reach patron automobiles. The impedance matching networks also allow the use of a lower transmitter output power since a greater proportion of the power reaches the automobile radios. Impedance matching networks are well known in the art and are constructed to properly match each particular input and output impedance.

Audio wiring circuits 42 and 44 are connected to coupling networks 38 and 40 respectively. Each coupling network is typically installed in a drive-in theater post which formerly held an outdoor speaker. Coupling networks 38 and 40 couple the radio frequency power to lead-in wires 46, 48, 50 and 52, which capacitively couple the radio frequency power to automobile radio antennas.

One embodiment of a lead-in wire which may be utilized with the present invention is disclosed by Sekiguchi, the inventor of the present invention in U.S. Pat. No. 4,047,109. Sekiguchi teaches an improved form of lead-in wire which utilizes capacitive coupling to effectively decouple any extraneous broadcast signals which may be picked up by the system wiring, but to strongly couple the relatively high amplitude sound track modulated radio frequency signal carried by the audio wiring circuits.

Coupling networks 38 and 40 are connected to coupling networks 54 and 56 by audio wiring circuits 58 and 60 respectively. In the same manner as coupling networks 38 and 40, coupling networks 54 and 56 couple radio frequency power to lead-in wires 62, 64, 66 and 68 and to audio wiring circuits 74 and 76.

The opposite ends of audio wiring circuits 74 and 76 terminate at termination networks 70 and 72 respectively. The networks 70 and 72 couple radio frequency power to automobile radio antennas through lead-in wires 78, 80, 82 and 84, and are also utilized to terminate the drive-in theater audio wiring 74 and 76 in such a manner as to prevent radio frequency power from being reflected back into transmitter 14. This is accomplished by providing at the ends of the audio wiring circuits 74 and 76 loads having an impedance which is the same as that of the wiring. Another function of the termination network is to dissipate most of the radio frequency power to prevent radiation of that power.

Radiation from the first power divider 18, the power level adjuster 24, the second power divider 24, the impedance matching networks 30 and 32, coupling networks 38, 40, 54 and 56, and coaxial cables 16, 22, 26, 34 and 36, and termination networks 70 and 72 is minimal assuming that the aforementioned devices are properly shielded. Thus, the greatest problem with radiation is from the drive-in audio wiring circuits 42, 44, 58, 60, 74 and 76 which are often unshielded. By matching the impedance of the audio wiring circuits and terminating the wiring, the wiring acts not as a radiator but as a transmission line thereby limiting its radiation.

Figure 2:
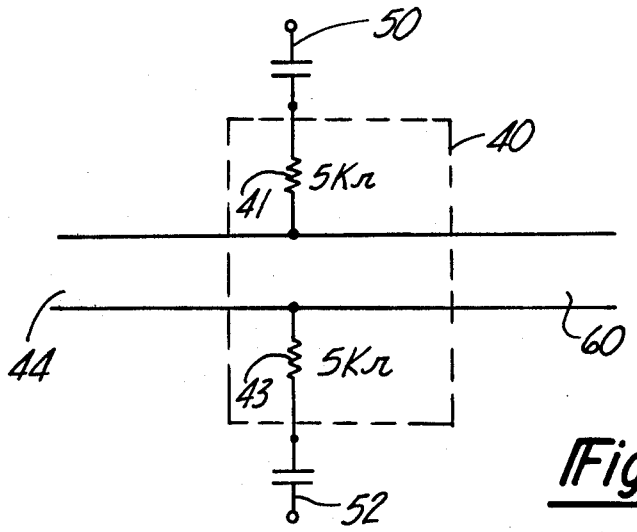

While a variety of forms of coupling networks might be used, a preferred embodiment is shown in FIG. 2. In FIG. 2 resistor 41 couples one side of the junction of audio wiring circuits 44 and 60 to lead-in wire 50. Resistor 43 couples the other side of the junction of audio wiring circuits 44 and 60 to lead-in wire 52. The values of resistors 41 and 43 are chosen to insure that the audio wiring circuits are not unduly loaded by the lead-in wires.

Figure 3:
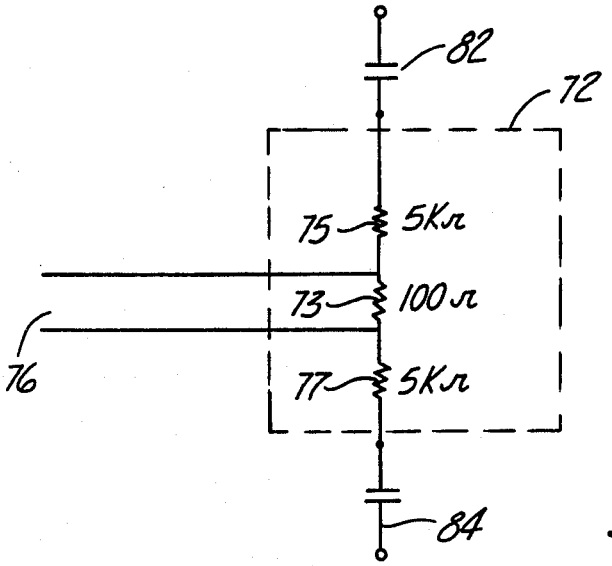
FIG. 3 is a schematic diagram of a termination network employed in connection with the preferred embodiment of FIG. 1.

Although different forms of termination networks can be used, a preferred embodiment is shown in FIG. 3. In FIG. 3 one end of audio wiring is connected across a resistor 73. The value of resistor 73 is chosen to match the impedance of the audio wiring circuit in order to provide proper termination. Without resistor 73 a correct impedance match between coaxial cable 36 and audio wiring 44, 60 and 76 would be difficult to achieve because the impedance of the audio wiring would vary with the use and physical position of lead-in wires 50, 52, 60, 68, 82 and 84.

In the same manner as the coupling network of FIG. 2 resistors 75 and 77 couple the radio frequency power to automobile radio antennas through lead-in wires 82 and 84 respectively. In a drive-in theater termination networks 70 and 72 would typically be located at the end posts of each row in the theater.

The embodiments of the invention in which an exclusive property or privilege is claimed are defined as follows:

1. A system for use in a drive-in theater for reproducing motion picture audio in a plurality of automobiles having radio receivers, said theater having unshielded audio wiring circuits which normally carry audio frequency transmissions, said system comprising:

a sound type motion picture projector;

an amplitude modulated, radio frequency, transmitter connected to the audio output of the projector;

power dividing means having a plurality of outputs;

a plurality of said audio wiring circuits in the theater, each audio wiring circuit being coupled to an output from the power divider means;

separate impedance matching means connected between each of the power dividing means outputs and their respective audio wiring circuits to match the impedance of the power dividing means to the impedance of one end of the audio wiring circuits;

a plurality of lead-in wires each having one end connected to a separate automobile radio receiver antenna connection;

a plurality of coupling networks connecting each audio wiring circuit to at least two lead-in wires at each of a plurality of points along the audio wiring circuit; and termination means having an impedance equal to the impedance of each audio wiring circuit connected to the other ends of the audio wiring circuits whereby said unshielded audio wiring circuits may be used as part of the transmission system to efficiently transmit the radio frequency audio portion of the motion picture.

2. The system of claim 1 wherein the impedance matching means comprises a plurality of passive components.

3. The system of claim 1 wherein said coupling network further comprises:

a first resistor connected between one conductor of an audio wiring circuit and a first lead-in wire, and a second resistor connected between the other conductor of an audio wiring circuit and a second lead-in wire.

4. The system of claim 1 wherein the termination means further comprises:

a resistor connected in parallel with the end of each wiring circuit.

5. The system of claim 1 wherein the lead-in wire further comprises:

a capacitively coupled elongated flexible conductor.

6. The system of claim 1 which further includes:

power level adjuster means for adjusting the power level associated with each audio wiring circuit.

7. In a drive-in movie theater having a plurality of rows of automobile parking spaces, each row equipped with an existing unshielded audio wiring circuit normally utilized to carry audio frequency signals to speaker locations at each parking space, an improvement comprising:

a sound-type motion picture projector;

radio frequency transmitter means connected to the audio output of the projector for providing radio frequency output signals containing the audio portion of the movie;

power divider means having an input coupled to said transmitter means and a plurality of outputs;

a plurality of shielded conductors coupled to the outputs from the power divider;

impedance matching means for coupling each of said audio wiring circuits to one of the shielded conductors from the power divider, operative to match the impedance of the power dividing means to the impedance of the audio wiring circuits to which it is connected;

a plurality of lead-in wires operative for connection at one end to a separate automobile radio receiver connection;

a plurality of coupling networks along spaced points of each audio wiring circuits located near the parking spaces, operative for connecting the other end of said lead-in wires to the audio wiring circuits; and termination means coupled to the ends of each audio wiring circuit having an impedance equal to the impedance thereof whereby said drive-in theater may be economically converted to a radio frequency system for efficiently transmitting the audio portions of the movie by using existing unshielded audio wiring circuits.

8. The improvement of claim 7 wherein said audio wiring circuits are coupled to their respective shielded conductor from said power divider means at substantially the center of each audio wiring circuit.

9. The improvement of claim 8 which further comprises:

a second power divider means having its input coupled to an output of the first power divider means, and two outputs, each output coupled to the inner ends of its associated audio wiring circuit.

10. The improvement of claim 9 wherein said impedance matching means comprises a first impedance matching network coupled between one output of said second power divider and one inner end of its associated audio wiring circuit portion, and a second impedance matching network coupled to the other output of said second power divider and the other inner end of its associated audio wiring circuit portion.

11. The improvement of claim 10 wherein said termination means further comprises:

a first termination network coupled to one outer end of its associated audio wiring circuit portion, and a second termination network coupled to the other outer end of its associated audio wiring circuit portion, each network having an impedance equal to the impedance of each audio wiring circuit portion to which it is connected.

12. The improvement of claim 11 wherein said first and second termination networks are located at opposite ends of one row of parking spaces in posts which formally held speakers.

13. The improvement of claim 12 which further comprises power level adjuster means for adjusting the amount of power transmitted to each wiring circuit associated with each row in the theater.

14. A method of converting a drive-in theater audio system, in which the theater contains nonshielded audio wiring circuits which are normally used for audio frequency transmissions, to a radio-frequency audio transmission system, said method comprising:

coupling an audio output of a sound type motion picture projector to a radio frequency transmitter;

amplitude modulating a carrier frequency signal in the standard broadcast band with the audio portion of the motion picture;

distributing the output of the transmitter by way of plurality shielded conductors;

connecting each of the shielded conductors to one of said nonshielded audio wiring circuits already in the theater through an impedance matching network;

tapping the audio wiring circuits along a plurality of points therein;

providing lead in wires for capacitively coupling the tapped audio wiring circuit to automobile radio antennas, and terminating each audio wiring circuit with an impedance equal to the characteristic impedance of the audio wiring circuits.

15. The method of claim 14 wherein the nonshielded audio wiring circuits are terminated by placing the characteristic impedance in speaker posts at the ends of the rows in the theater.

16. The method of claim 14 wherein the shielded conductors are coupled to central portions of the audio wiring circuits through a power divider.

17. The method of claim 16 wherein inner portions of each audio wiring circuit are coupled to the power divider through separate impedance matching networks.

18. The method of claim 17 wherein the outer portions of each audio wiring circuit are terminated by characteristic impedances located in the speaker posts at the ends of the rows in the theater.

19. The method of claim 14 which further comprises selectively adjusting the power level to each of the audio wiring circuits depending upon the transmission characteristics of each circuit.

20. The method of claim 14 wherein the audio wiring circuits are tapped by coupling networks installed in a drive-in theater post which formerly held a speaker.

* * * * *